US006670777B1

(12) United States Patent
Petruska et al.

(10) Patent No.: US 6,670,777 B1
(45) Date of Patent: Dec. 30, 2003

(54) IGNITION SYSTEM AND METHOD

(75) Inventors: David C. Petruska, Fort Collins, CO (US); Jeffrey B. Barrett, Bolton, MA (US); Mark R. Woolston, Bolton, MA (US)

(73) Assignee: Woodward Governor Company, Rockford, IL (US)

( * ) Notice: Subject to any disclaimer, the term of this patent is extended or adjusted under 35 U.S.C. 154(b) by 0 days.

(21) Appl. No.: 10/185,765

(22) Filed: Jun. 28, 2002

(51) Int. Cl.[7] ..... H05B 37/02

(52) U.S. Cl. ..... 315/209 CD; 361/253; 123/598; 123/606

(58) Field of Search ..... 315/209 CD, 241 R, 315/247, 278, 279, 225; 361/253, 257; 123/598, 606, 607, 620, 635, 653

(56) References Cited

U.S. PATENT DOCUMENTS

| | | | | |
|---|---|---|---|---|
| 2,717,335 A | 9/1955 | Sims et al. | 315/183 |
| 2,980,822 A | 4/1961 | Short | 315/180 |
| 3,045,148 A | 7/1962 | McNulty et al. | 315/183 |
| 3,049,642 A | 8/1962 | Quinn | 315/206 |
| 3,169,212 A | 2/1965 | Walters | 315/223 |
| 3,176,158 A | 3/1965 | Guignard | 327/124 |
| 3,223,887 A | 12/1965 | Brown | 315/223 |
| 3,240,198 A | 3/1966 | Loudon et al. | 123/406.57 |
| 3,302,629 A | 2/1967 | Shano | 123/598 |
| 3,331,033 A | 7/1967 | Johnston | 331/111 |
| 3,424,945 A | 1/1969 | Seider et al. | 315/240 |
| 3,450,942 A | 6/1969 | Segall et al. | 315/209 CD |
| 3,504,658 A | 4/1970 | Chavis | 123/604 |
| 3,505,563 A | 4/1970 | Randall et al. | 315/213 |
| 3,546,528 A | 12/1970 | Fisher | 315/209 CD |
| 3,560,833 A | 2/1971 | Oishi et al. | 363/18 |
| 3,569,727 A | 3/1971 | Aggarwal et al. | 307/106 |
| 3,600,887 A | 8/1971 | Gault et al. | 60/39.14 |
| 3,635,202 A | 1/1972 | Issler et al. | 123/148 E |
| 3,681,001 A | 8/1972 | Potts | 431/264 |
| 3,750,637 A | 8/1973 | Minks | 123/148 E |

(List continued on next page.)

FOREIGN PATENT DOCUMENTS

| | | | |
|---|---|---|---|
| CH | 124406 | 12/1925 | |
| DE | 1 539 195 | 3/1972 | F02P/3/08 |
| DE | 2 040 913 | 3/1973 | F02P/17/00 |

(List continued on next page.)

OTHER PUBLICATIONS

G. Geoffrey Smith, "Gas Turbines and Jet Propulsion for Aircraft", 4th Edition, 1946, p. 78.

(List continued on next page.)

*Primary Examiner*—Hoang V. Nguyen
(74) *Attorney, Agent, or Firm*—Greer, Burns & Crain, Ltd.

(57) ABSTRACT

An ignition system for an engine includes an exciter circuit for use with an igniter, the exciter circuit having a step-up transformer the utilizes a relatively low voltage in its primary to produce a high voltage pulse that is applied to the igniter to create ionization and breakdown. The system also utilizes a low voltage high energy circuit to provide high current energy to the igniter after initial breakdown and during the plasma arc phase. The high energy circuit is decoupled from the step-up transformer so that high current is conducted through a bypass diode rather than through the transformer.

34 Claims, 3 Drawing Sheets

U.S. PATENT DOCUMENTS

| | | | | | |
|---|---|---|---|---|---|
| 3,839,659 | A | | 10/1974 | Bruijning et al. | 315/209 SC |
| 3,852,623 | A | | 12/1974 | Nelson et al. | 307/293 |
| 3,857,376 | A | | 12/1974 | Williams | 123/148 E |
| 3,918,425 | A | | 11/1975 | Pulzer | 123/148 E |
| 4,027,198 | A | | 5/1977 | Linkroum | 315/209 CD |
| 4,129,895 | A | | 12/1978 | Witting | 361/257 |
| 4,167,767 | A | | 9/1979 | Courier de Mere | 361/256 |
| 4,479,467 | A | | 10/1984 | Burrows et al. | |
| 4,502,454 | A | | 3/1985 | Hamai et al. | 123/597 |
| 4,510,915 | A | | 4/1985 | Ishikawa et al. | 123/620 |
| 4,558,280 | A | | 12/1985 | Koehl et al. | 324/399 |
| 4,688,538 | A | | 8/1987 | Ward et al. | 123/598 |
| 4,696,280 | A | | 9/1987 | Niggemeyer | 123/598 |
| 4,758,790 | A | | 7/1988 | Hunt | 324/379 |
| 4,760,341 | A | | 7/1988 | Skerritt | 324/379 |
| 4,783,991 | A | | 11/1988 | Wixon | 73/117.3 |
| 4,825,167 | A | | 4/1989 | Bayba | 324/399 |
| 4,829,971 | A | | 5/1989 | Minks | 123/598 |
| 4,922,396 | A | | 5/1990 | Niggemeyer | 363/21 |
| 5,032,969 | A | | 7/1991 | Eggers et al. | 363/21 |
| 5,053,913 | A | | 10/1991 | Lozito et al. | 361/257 |
| 5,065,073 | A | | 11/1991 | Frus | 315/209 R |
| 5,197,448 | A | * | 3/1993 | Porreca et al. | 123/620 |
| 5,247,422 | A | | 9/1993 | Miller | 361/632 |
| 5,347,422 | A | * | 9/1994 | Smith et al. | 361/253 |
| 5,561,350 | A | | 10/1996 | Frus et al. | 315/209 R |
| 5,862,033 | A | | 1/1999 | Geislinger et al. | 361/257 |
| 6,052,270 | A | * | 4/2000 | Kinge | 361/253 |
| 6,112,730 | A | * | 9/2000 | Marrs et al. | 123/606 |
| 6,191,537 | B1 | * | 2/2001 | Celso | 315/219 |

FOREIGN PATENT DOCUMENTS

| | | | |
|---|---|---|---|
| DE | 27 24 797 | 11/1978 | H01B/7/00 |
| EP | 0 020 069 | 12/1980 | F02P/17/00 |
| EP | 0 125 820 | 11/1984 | F02C/9/00 |
| EP | 0 226 302 | 6/1987 | F02C/7/266 |
| EP | 0 228 840 | 7/1987 | F02P/9/00 |
| EP | 0 277 468 | 8/1988 | G01R/29/027 |
| EP | 0 384 436 | 8/1990 | F02P/17/00 |
| FR | 1097275 | 2/1954 | |
| FR | 2 317 804 | 2/1977 | F02P/3/06 |
| GB | 529558 | 11/1940 | |
| GB | 637286 | 5/1948 | |
| GB | 633854 | 12/1949 | |
| GB | 661410 | 11/1951 | |
| GB | 682877 | 11/1952 | |
| GB | 762097 | 11/1956 | |
| GB | 762119 | 11/1956 | |
| GB | 808991 | 2/1959 | |
| GB | 896161 | 5/1962 | |
| GB | 962417 | 7/1964 | |
| GB | 992288 | 5/1965 | |
| GB | 997139 | 7/1965 | |
| GB | 1 018963 | 2/1966 | |
| GB | 1027259 | 4/1966 | |
| GB | 1035656 | 7/1966 | |
| GB | 1037664 | 8/1966 | |
| GB | 1045812 | 10/1966 | |
| GB | 1063257 | 3/1967 | |
| GB | 1085434 | 10/1967 | |
| GB | 1102267 | 2/1968 | F02P/3/10 |
| GB | 1106511 | 3/1968 | F02P/3/06 |
| GB | 1106923 | 3/1968 | F02P/3/00 |
| GB | 1109052 | 4/1968 | F02P/3/06 |
| GB | 1109158 | 4/1968 | F02P/3/06 |
| GB | 1111791 | 5/1968 | F02P/3/00 |
| GB | 1117181 | 6/1968 | F02P/3/08 |
| GB | 1132103 | 10/1968 | F02P/3/06 |
| GB | 1135530 | 12/1968 | F02P/3/02 |
| GB | 1136243 | 12/1968 | F02P/3/06 |
| GB | 1170020 | 11/1969 | F02P/3/06 |
| GB | 1179229 | 1/1970 | F02P/3/06 |
| GB | 1182726 | 3/1970 | F02P/3/06 |
| GB | 1239756 | 7/1971 | F02P/3/06 |
| GB | 1255542 | 12/1971 | H03B/5/12 |
| GB | 1256885 | 12/1971 | H03K/3/335 |
| GB | 1263248 | 2/1972 | F02P/3/06 |
| GB | 1268290 | 3/1972 | F02P/3/06 |
| GB | 1283905 | 8/1972 | F02P/3/06 |
| GB | 1327564 | 8/1973 | F02P/3/06 |
| GB | 1334230 | 10/1973 | F02P/3/00 |
| GB | 1353588 | 5/1974 | F02P/3/06 |
| GB | 1396280 | 4/1975 | F23N/5/00 |
| GB | 1400446 | 7/1975 | F02P/3/06 |
| GB | 1414920 | 11/1975 | F02P/3/02 |
| GB | 1424195 | 2/1976 | F02P/3/06 |
| GB | 1464477 | 2/1977 | G01R/19/00 |
| GB | 1467286 | 3/1977 | F02P/3/06 |
| GB | 1493391 | 11/1977 | F02P/3/02 |
| GB | 1537278 | 12/1978 | F02C/7/26 |
| GB | 1537279 | 12/1978 | F02C/7/26 |
| GB | 1551746 | 8/1979 | G01R/31/00 |
| GB | 1571884 | 7/1980 | F02P/3/04 |
| GB | 2064138 | 6/1981 | G01R/31/00 |
| GB | 2085523 | 4/1982 | F02P/3/08 |
| GB | 2130751 | 6/1984 | G05B/23/02 |

OTHER PUBLICATIONS

John W. Sawyer, "Sawyer's Gas Turbine Engineering Handbook", vol. 3, 3rd Edition, 1985, pp. 7–32–7–39.

Hans–Peter Hempel, "Pow er Semiconductor Handbook", 1980, pp. 11–17 and 103.

EHJ Pallett, "Aircraft Electrical Systems", 1989, pp. 161.

Lucas Aerospace, Overhaul Manual, 1978, pp. 2–3.

Rex M. Davis, "Pow er Diode and Thyristor Circuits", 1971, pp. 9–11.

"Solid–State Devices Manual", RCA Corporation, Mar., 1975, pp. 150–173 and 448–471.

R. Greenwood, "Automotive and Aircraft Electricity", 1969, p. 160–161.

F.E. Gentry, F.W. Gutzw iller, N. Holonyak, Jr., E.E. Von Zastrow , "Semiconductor Controller Rectifiers: Principles and Applications of p–n–p–n Devices", 1964, p. 369–370.

R.W. Burke and C.J. Dunne, "A Transistorized Contactless Low Voltage Ignition System", 1963, pp. 52–56.

H.C. Welch, "Solid–State Ignition", Jun. 1963, pp. 47–51.

Lucas Aerospace, Overhaul Manual Type NB. 9518 & NB. 9568 High Energy Ignition Units, 1979.

M.W. Burgher, "Interrelated Parameters of Gas Turbine Engine Design and Electrical Ignition Systems", 1963, pp. 1–6.

J. Markus, "Modern Electronic Circuits Reference Manual", 1980, p. 764.

"Low Voltage Exciter", Aviation Equipment Maintenance, Dec. 1988.

R. Ramshaw , "Pow er Electronics Thyristor Controlled Pow er for Electric Motors", 1973, pp. 23–26.

R.F. Graf, G.J. Whalen, "Solid–State Ignition Systems", 1974, Chapters 1, 3, 5.

General Electric, "SCR Manual Sixth Edition", 1979, p. 141.

F.F. Mazda, "Thyristor Control", 1973, pp. 72–73 and 100–103.

W.B. Larew, "Ignition Systems", 1968, pp. 162–180, 198–202.

Rolls–Royce plc, "The Jet Engine", 1986, pp. 121–131.

Society of Automotive Engineers, Inc., "Capacitor Discharge, Piezo Electric, and Transistorized Spark Ignition Systems", 1965, pp. 9–11.
B.J. Min, H.W. Wearsch, "An Improved Snubber Circuit for Power Semiconductors", IAS, 1977, pp. 1017–122.
General Electric Company , "Thyristors–Rectifiers", 1982, pp. 5, 10–18, 33,43, 55–56, 74–77.
J.J. Tracy, R.B. Bailey , "Ferrites Simplify Snubber Design for a Traction Chopper Utilizing Series Thyristors", 1975, pp. 332–339.
D.A. Paice, P. Wood, "Nonlinear Reactors as Protective Elements for Thyristor Circuits", 1967 , pp. 228–232.
J.G. Tracy , P.B. Bailey, "How to Simplify Snubber Design Using Ferrite", 1974.
B.M., K.G. King, "An Introduction to Pow er Electronics", 1983, pp. 22–34.
Sen, "Pow er Electronics", 1987, pp. 60–65.
Eyquem S.A., "Fiche Technique No. 251", 1978.
Turbomeca Etudes, Note Technique No. 2347, 1974.
Ge Thyristor Catalog, 1979, p. 141.
Sescosem, "Rectifiers, Diodes, Thyristors", 1976, pp. 439–459.
K.W. Cattermole, "Transistor Circuits", 1964, pp. 320–329, 458–461, 468–469.
R.W. Anderson, "The Effect of Ignition System Pow er on Fast Burn Engine Combustion", Jan. 1987.
S. Pischinger, "Effects of Spark Plug Design Parameters on Igntion and Flame Development in an SI–Engine", submitted at the Massachusetts Institute of Technology, Jan. 1989.
Edw ards et al., "Comparative Study of Plasma Ignition Systems", SAE Technical Paper Series, SAE The Engineering Resource for Advancing Mobility, International Congress & Exposition, Detroit, MI, Feb. 28–Mar. 4, 1983.

* cited by examiner

IGNITION SYSTEM AND METHOD

BACKGROUND OF THE INVENTION

The present invention generally relates to ignition systems and more particularly to such systems, as well as to an exciter circuit and a method of igniting fuel.

Ignition systems for turbine engines as well as other applications have been in use for decades and they continue to evolve with changing technology. Recent developments have included the incorporation and use of solid state semiconductor power switching devices for releasing energy from an energy storage device for generating a spark discharge for igniting fuel in a turbine engine, for example. Such solid state devices are considered to be more reliable than gas discharge tubes that had been previously employed for decades. Because such systems often have to reliably operate in severe environmental conditions that include significant temperature and air pressure variations, and because reliability and safety considerations are of paramount concern when the ignition systems are used in aircraft engines, for example, such systems must be carefully designed for effective and reliable operation.

It has been generally consistent practice to design exciter circuitry that is used in connection with an igniter plug to employ a relatively high voltage bus, i.e., on the order of at least 2000 to 3000 volts, so that the igniter plug reliably produces a sufficient spark during operation. Serious design consideration has been given to not only producing a sufficient initial spark, but also one that is sustained so that reliable ignition of the fuel occurs in the engine, particularly in severe environmental conditions. However, when a high voltage bus is utilized in the design of the exciter circuit, the components that operate in the circuit must be capable of withstanding the high voltage and current loads that are experienced. For example, if a high energy capacitor is utilized in an exciter circuit and its energy is released by a silicon controlled rectifier (SCR) switch, such a single SCR switch that can handle the high voltage and current loading may be very expensive. Alternatively, a switch design may be utilized which employs multiple SCR's connected in a more complex circuit arrangement. More particularly, such high voltage switching is often performed by multiple series connected SCR's which must be very carefully matched and triggered during operation or they will likely prematurely fail.

While such high voltage ignition systems not only experience the problems associated with finding reliable and cost efficient components that can be used in such a high voltage environment, they also do not necessarily result in the most efficient ignition current waveform of energy delivery to the igniter plug. Typically, a wave shaping inductor is placed between the energy storage capacitor and the igniter in order to increase the current duration and decrease the peak current going to the igniter.

SUMMARY OF THE INVENTION

The present invention includes a preferred embodiment ignition system for a turbine engine which includes an exciter circuit that has a step-up transformer utilizing a relatively low voltage in its primary to produce a high voltage pulse that is applied to an igniter to create ionization and breakdown. The system also utilizes a low voltage high energy circuit to provide high current energy to the igniter after initial breakdown and during the plasma arc phase. The high energy circuit is decoupled from the step-up transformer so that high current is conducted through a bypass rather than through the transformer. Moreover, the low voltage of the high energy circuit allows for smaller, less expensive and more robust semiconductors to be used as the high energy switch.

The exciter circuitry carefully times the release of energy from a separate primary side capacitor to the step-up transformer relative to the operation of the SCR switch that releases the energy from the high energy capacitor, which desirably protects the high energy SCR switch during generation of the high voltage pulse that is applied to the igniter plug. The low voltage topology, which utilizes very large capacitance for the high energy capacitors, produces an ignition current waveform with longer duration and lower peak current than traditional prior art systems of equivalent stored energy. The lower peak currents place lower peak power stresses on the exciter components, while the longer duration ensures high energy delivery through the igniter plug to the combustible air/fuel mixture.

In the preferred embodiment of the present invention, the high capacitance (e.g., 75 $\mu$F) associated with the low voltage system (e.g., 650V) allows for increasing current durations in the presence of increasing external resistance. The low capacitance (e.g., 3.5 $\mu$F) associated with a traditional high voltage (e.g., 2800V) system typically requires the addition of a current discharge wave shaping inductor which increases the current duration while reducing the peak currents to reasonable levels. Furthermore, a low capacitance, unipolar system utilizing a typical wave shaping inductor exhibits decreasing current durations in the presence of increasing external resistance. Thus, the energy delivery in the presence of increasing external resistance is more consistent with a low voltage system. Sources of external resistance include the ignition lead, which connects the exciter and igniter, along with the igniter and igniter extensions.

DETAILED DESCRIPTION OF THE PREFERRED EMBODIMENT

Broadly stated, the present invention is described and implemented in a preferred embodiment that is particularly useful as an ignition system for a turbine engine. However, it should be appreciated that the invention described in this patent can be used in a much broader context that is certainly not limited to an ignition system for a turbine engine. The present invention certainly extends to and can be used more generally as an energy discharge device or system that provides energy to an output that could be as diverse an application as for energizing a laser. The invention may also be used as an ignition system for gas or oil fired furnaces, internal and external combustion engines, including piston engines, as well as turbine engines.

Figure 1:
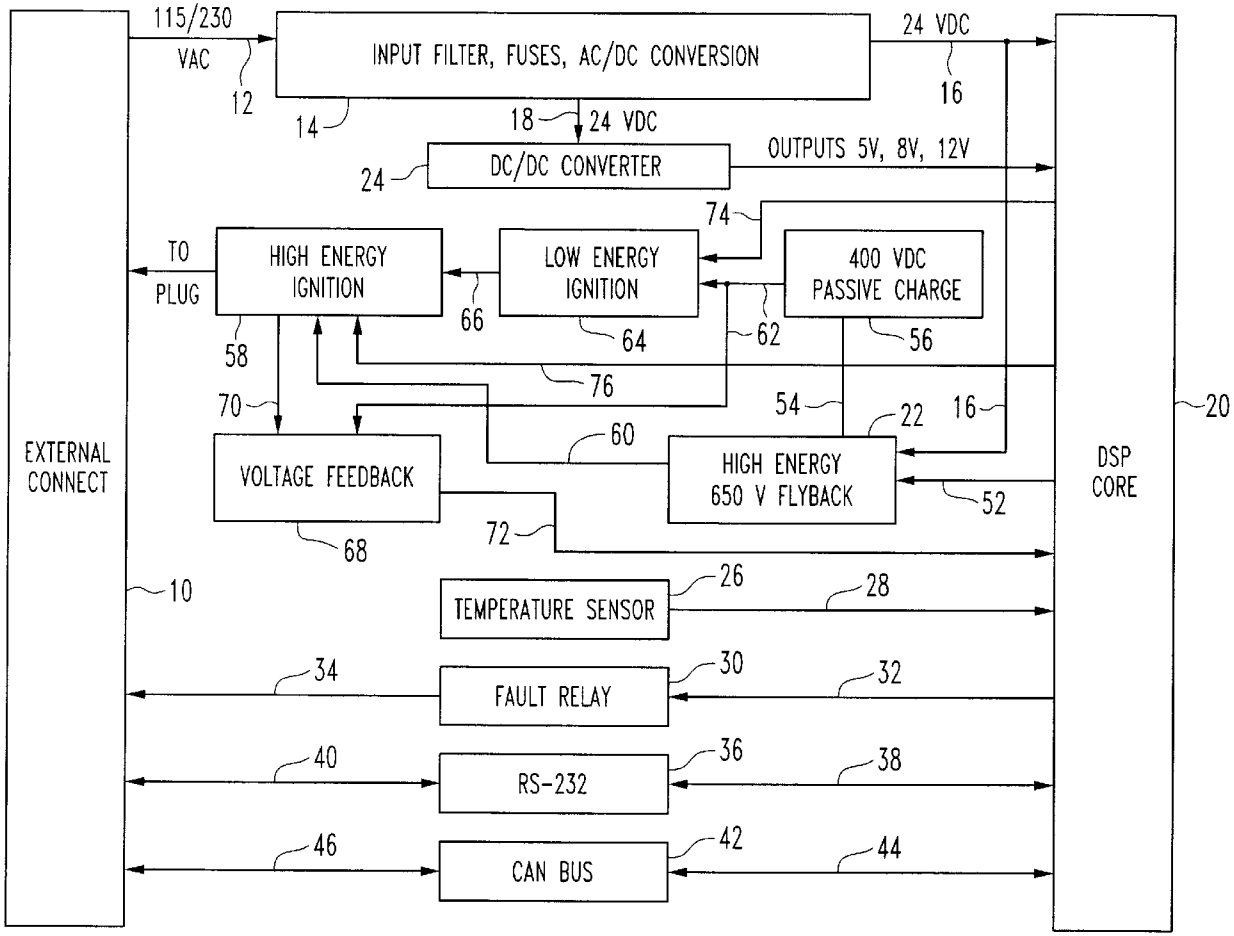
FIG. 1 is a block diagram of a preferred embodiment of a turbine ignition system of the present invention.

The preferred embodiment of the ignition system of the present invention is shown in the block diagram of FIG. 1 and includes a set of external connectors indicated generally at 10 for inputting AC power to the system as well as for providing communications between the system and other systems that may be utilized by a user for diagnostic purposes or for the purposes of checking or modifying software used in the operation of the system.

AC power is provided on lines 12 which are connected to input power conditioning circuitry 14 that preferably comprises an EMI input filter, fuses and an AC to DC conversion circuitry which outputs an unregulated 24VDC power on lines 16 and 18. Line 16 is connected (via a voltage divider) to a digital signal processor 20, but is not used to drive it, and line 16 is also connected to a high energy 650 flyback circuit 22 (figure needs to be corrected to read "650" not "560". The digital signal processor or DSP 20 is preferably a microcontroller or microprocessor and preferably has several analog to digital converter inputs, including one where line 16 is applied to the DSP 20 so that it can monitor the voltage range during operation.

The conditioning circuitry 14 is preferably standard transformer and rectification functionality that provides a relatively uncontrolled 24VDC bus at output line 16 and it is not important that the output voltage be controlled within a limited range. In practice, the output can vary between 18 to 40 volts as a function of the input AC voltage and also the load being drawn essentially as a function of the operation of the high energy flyback circuit 22. The 24VDC power applied on line 18 powers a DC to DC converter circuit 24 that provides a regulated output of 5 volts, and unregulated outputs of 8 volts and 12 volts for powering logic circuits and the DSP20. The AC to DC conversion circuitry 14 as well as the DC to DC converter 24 are considered conventional and are therefore not shown in detail.

The system includes a temperature sensor 26 that provides a signal to the DSP 20 for the purpose of monitoring the operation of the system. When the temperature of the circuit boards in which the circuitry is implemented reaches very high temperatures, the DSP 20 detects that and reduces the frequency of sparks being generated by the system. In this regard, it should be understood that heat is generated in proportion to the operation of the circuit and the more often the system fires, the more heat is generated in the circuit module. For example, if the system fires at a nominal 1.8 Hz frequency at an ambient temperature of 85°, when the ambient temperature exceeds 100°, the firing rate may be reduced to 1 Hz. It should also be understood that such frequency variations as well as the values which are used to change the firing rate may be programmed in the DSP 20.

The system also preferably includes a fault relay 30 that is connected to the DSP 20 by line 32 and it has an output line 34 which may extend to other circuitry that may be used to control the operation of the turbine engine itself. The fault relay 30 may be triggered when the DSP senses through its inputs that something may be wrong with the overall operation of the system. It provides a state signal that can be employed by a user to provide further signals or to control the operation of the turbine engine itself.

An RS 232 module 36 is connected to the DSP via line 38 and it has an output line 40 for communicating with other facilities as desired. In this regard, the RS 232 communication line can be used by engineers to load or revise software relating to the operation of the DSP. The system may also include a CAN or centralized area network bus 42 that is essentially a serial bus that is connected to the DSP via line 44 and it has output line 46 for communicating with the outside world. It could, for example, report all of the parameters that the DSP was measuring and forward such data for diagnostic purposes. The RS 232 as well as the CAN bus circuitry are also conventional and are therefore not described in detail.

As previously mentioned, the preferred embodiment of the present invention has a dual functionality in that it produces a high voltage pulse that is applied to the igniter plug which causes it to ionize and discharge and that event is closely followed by a high energy current being applied to the igniter plug. Referring to the block diagram, the high energy 650 volts flyback charger 22 is controlled by the DSP 20 via line 52. The flyback charger 22 is also connected to a low energy 400 VDC passive charger circuit 56 by a line 54 and to a high energy capacitor located in a high energy ignition circuit 58 by a line 60. The charger 56 has output line 62 that extends to a low energy ignition circuit 64 which contains the high voltage step-up transformer and low energy capacitor. The low energy ignition circuit 64 is connected to the high energy ignition circuit 58 via line 66.

The charge on the low energy capacitor in circuit 64 as well as the high energy capacitor in circuit 58 is provided to a voltage feedback circuit 68 through line 70 and 62 and the voltage feedback circuit 68 provides signals on line 72 to the DSP 20 for determining when both the high energy capacitor and the low energy capacitor are charged to their predetermined levels. While the specific circuitry that implements this portion of the block diagram will be described in detail, the operation essentially comprises the DSP providing a signal on line 52 to the flyback circuitry 22 which causes it to turn on and begin to charge up the low energy capacitor in block 64 as well as the high energy capacitor in block 58. As both capacitors are charging, they provide signals on respective lines 62 and 70 that is reported back to the DSP via line 72. When both capacitors reach their predetermined charge value, which takes approximately 300 milliseconds, the DSP provides a signal to the circuit 52 to stop charging. When both capacitors are charged to their desired energy value, the DSP then fires the SCR switches in block 64 and 58 in their proper timed sequence and ignition occurs. More particularly, the DSP 20 initiates firing of the circuit by initially triggering the switch which releases the energy from the high energy capacitor bank with that signal being applied by the DSP 20 on line 76, followed by triggering of the switch that discharges the low energy capacitor in circuit 64 with the trigger signal being applied on line 74.

The feedback functionality also enables the DSP 20 to perform diagnostic operations utilizing the monitored values that it receives. For example, if the ignition system is fired and a millisecond later the DSP 20 detects that there is still a large voltage on the capacitors, the DSP can conclude that there was a malfunction in the firing circuitry or that the igniter plug was either dead or missing.

It should also be understood that the output signals from the DSP are typically in the range of 3 volts and are very low power signals. Since the SCR switches need to be driven with a much larger signal, it should be understood to one of ordinary skill in the art that conditioning and converting circuitry is necessary to interface the signals from the DSP 20.

Figure 2:
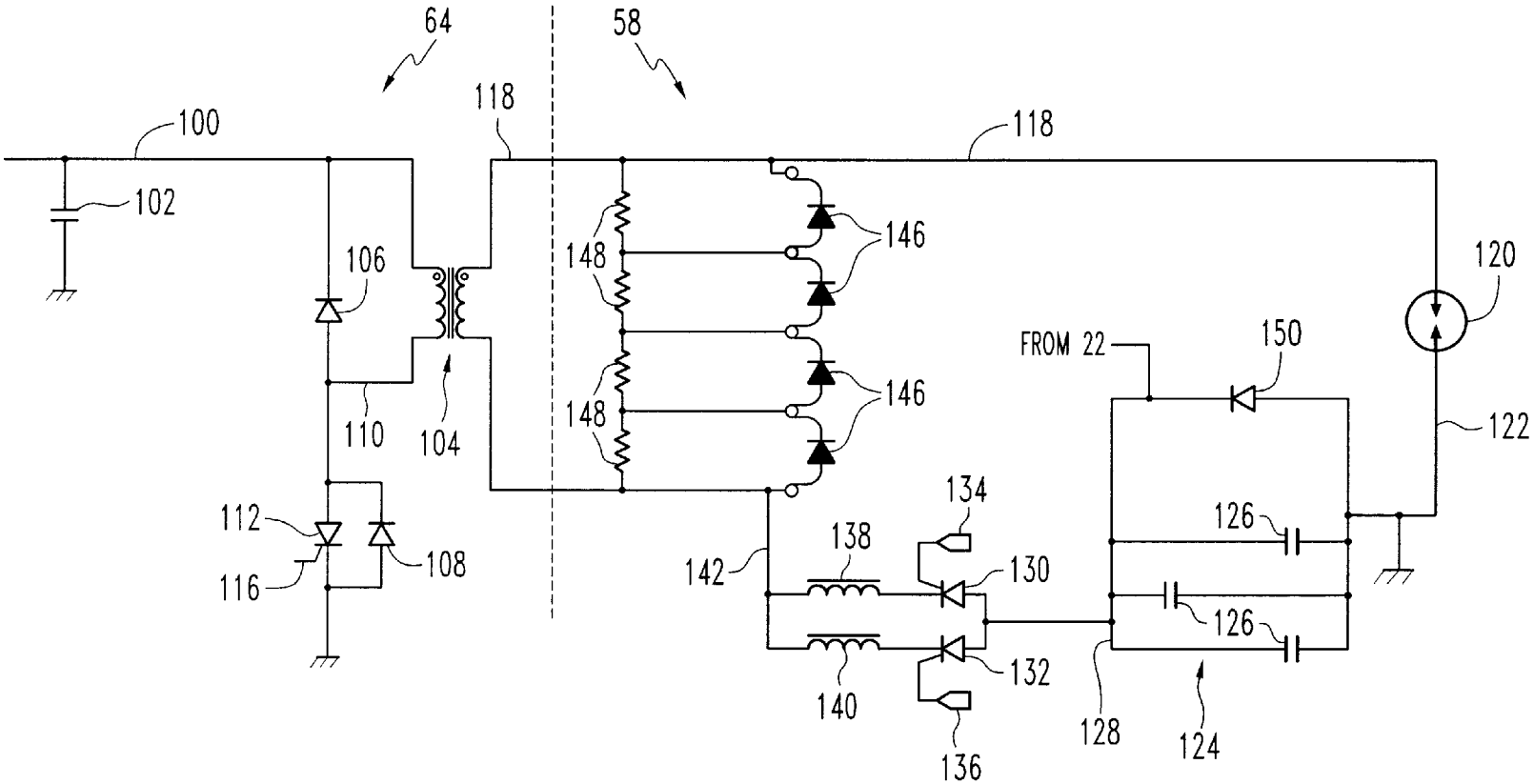
FIG. 2 is a simplified electrical circuit schematic diagram of the preferred embodiment of the present invention; and, FIG. 3 is an electrical timing diagram illustrating aspects of the operation of the preferred embodiment.

Turning now to the specific circuitry of the high energy ignition circuitry 58 and the low energy ignition circuit 64, and referring to FIG. 2, the portion to the left of the vertical dotted line illustrates the low energy ignition circuit whereas the portion to the right of it represents the high energy ignition circuitry 58. Line 100 is connected to the low energy capacitor 102 and to the primary winding of a step-up transformer 104 as well as to the cathode of a diode 106. The anode of the diode 106 is connected to line 110 that is also connected to the primary winding of the transformer 104 and to the anode of an SCR 112, the cathode of which is connected to ground 114. Diode 108 is connected "anti parallel" with SCR 112. A gate terminal 116 is connected to the DSP through conditioning circuitry that provides sufficient power to place the SCR 112 into conduction rapidly once it is triggered.

The secondary winding of the transformer 104 is connected to line 118 that extends to one terminal of an igniter plug 120, the other terminal of which is connected via line 122 to ground as well as to one terminal of a capacitor bank 124 having three parallel connected capacitors 126. The opposite side of the capacitor bank has line 128 connected to a pair of SCR's 130 and 132. Respective gate terminals 134 and 136 are connected to the DSP 20 through suitable conditioning circuitry to provide the proper energy level at the gates of the SCR's to rapidly place them into full conduction. The cathodes of the SCR's 130 and 132 are connected to respective inductors 138 and 140 which are in turn connected via line 142 to the secondary winding of the transformer 104 as well as to a number of series connected diodes 146 and a number of series connected resistors 148 that are individually connected in parallel to an associated diode. The diodes 146 are also connected in parallel with the secondary winding of the transformer 104 in addition to being in parallel with the resistors 148. It should be understood that the SCR's 130 and 132, while shown to be connected in parallel, could be series connected, and the series connected diodes 146 could also be parallel connected.

With regard to the low energy ignition circuit, the low energy capacitor 102 is charged to a voltage of approximately 400 volts DC by the passive charge circuit 56 (not shown in FIG. 2). The low energy capacitor has an energy capacity of less than 2 Joules and is preferably about 300 millijoules. (approximately 4 microFarads) which provides the energy for generating the high voltage pulse at the output line 118 when the low energy capacitor is discharged through the primary winding of the transformer 104. This occurs when the DSP generates a pulse that is conditioned and applied to the gate terminal 116 of the SCR 112. When the SCR 112 is gated into conduction, the current from the capacitor 102 flows through the primary winding and by virtue of the ratio of windings from the primary to secondary, produces an open circuit voltage up to preferably between approximately 15,000 and approximately 20,000 volts in the secondary which appears on line 118 and is applied to the igniter plug 120. In this regard, the voltage may be within a larger range of between 1,000 and 50,000 volts and still be functionally operable, but the approximately 15,000 to approximately 20,000 volt range is known to produce reliable operation.

The DSP 20 turns on the high energy 650 volt flyback circuit 22 to charge the capacitor bank 124 to a voltage of preferably about 650 volts. After the capacitor 124 is charged, the DSP 20 produces a trigger signal on line 76 which is conditioned by circuitry (not shown) to provide a robust gate signal to gate terminals 134 and 136 to switch the SCR pair 130, 132 into conduction. It is important to place the SCR's 130 and 132 in conduction quickly so that the current from the capacitor 124 does not damage the SCR's. In this regard, the capacitor bank 124 has an energy capacity of less than 20 and preferably approximately 16 Joules so that when the SCR switches 130 and 132 are triggered into conduction, a current flow of approximately 1,000 to 2,000 amperes is produced.

The energy is conducted through the SCR's into saturable reactors 138 and 140. These saturable reactors are included for the purpose of protecting the SCR's from damage due to excessive current flow and also to ensure current sharing between the parallel connected SCR's. The current limiting function, which is preferably only approximately 4 to 5 microseconds, but which may be within the range of approximately 1 to approximately 10 microseconds, gives the SCR's time to bring sufficient area of their structure into conduction before high current starts to flow. After the very short delay, the high rate of change of current, di/dt, is permissible without causing damage to the SCR's. This is particularly useful under ignition lead faults which would result in very high peak currents with very high di/dts. Additionally, the impedance of the saturable reactor after saturation helps share the high energy current between the parallel connected SCR switches. The current then flows through line 142 to the series connected diodes 146 which are connected in parallel with the secondary winding of the transformer 104 and the high current is conducted to line 118 through these multiple diodes 146.

Because the voltage that is generated by the high voltage pulse is up to 20,000 volts, the four diodes 146 that are utilized are rated at 5000 volts each. These are relatively expensive diodes, but are necessary to the proper operation of the system. The use of the resistors 148 in parallel insure that the voltage of each diode is shared more or less equally. It should be appreciated that there is a significant heat loss in these high voltage diodes because high voltage diodes typically have a lot of resistive loss when they are conducting current. With current levels in the range of 1,000 to 2,000 amps being conducted through the diodes 146, they tend to become relatively hot. By using four 5,000 volts diodes, the heat generated is spread among four semiconductor diodes.

Figure 3:
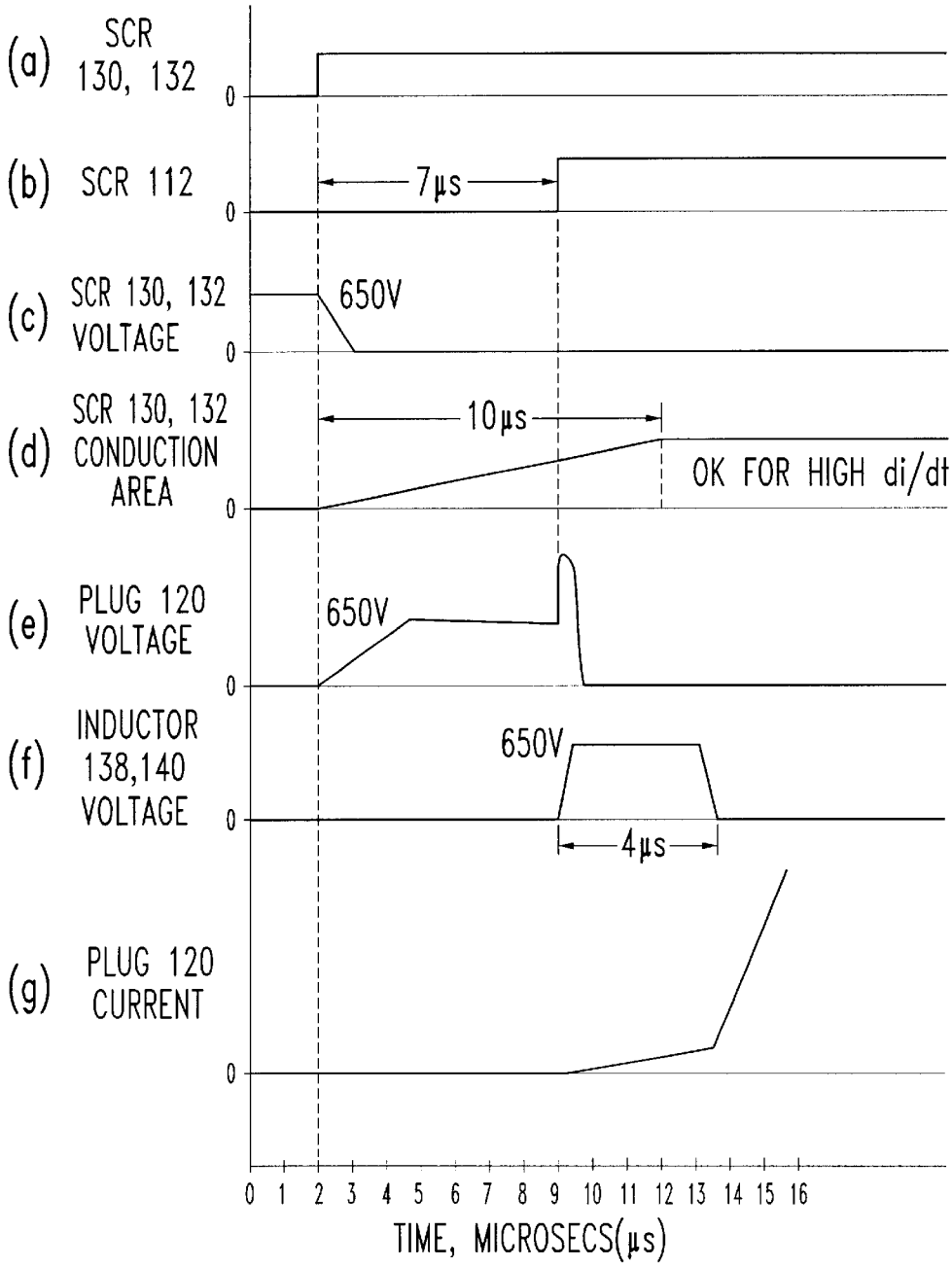

During operation and referring to FIG. 3, the DSP 20 initially triggers the SCR's 130, 132 when the capacitor bank 124 and the low energy capacitor 102 are charged to their respective voltages of 650 and 400 volts. When the SCR's are placed into conduction at a particular time, (FIG. 3a) then preferably approximately 5 to 7 microseconds later, the SCR 112 is gated into conduction as shown in FIG. 3*b*. In this regard, it should be understood that the delay between triggering the SCR's 112 and 130 may be within the range of approximately 0.1 to approximately 10 microseconds. The voltage on SCR 130, 132 is initially at 650 volts but quickly declines to 0 in approximately 1 microsecond as shown in FIG. 3*c*. The conduction area of the SCR 130 and 132 gradually ramps up in 5 to 10 microseconds and is then conditioned for high rates of current flow as illustrated in FIG. 3*d*. As shown in FIG. 3*e*, the voltage applied to the plug 120 starts at 0 and increase to 650 volts when SCR 130 is gated in conduction and maintains that voltage level until the SCR 112 fires causing the high voltage pulse of up to about 15,000 to about 20,000 volts to be generated which creates ionization and breakdown of the plug 120, placing it into conduction (typical breakdowns may be between 1 and 5 kV). The reactor voltage transitions from 0 to about 650 volts when breakdown occurs and it limits current flow until the saturable reactor saturates which requires approximately 5 microseconds whereupon the rate of current rise increases dramatically as shown in FIG. 3*g*.

The diode 106 is a freewheeling or flyback diode that is often included as a matter of standard practice. Whenever there is an inductive load such as an ignition coil or the primary winding of the transformer 104 in the illustrated circuit, when the SCR 112 opens, there is still current flowing in the primary coil of the transformer and the energy has to be conducted to some destination or a very high voltage spike will be produced. Its presence insures better reliability.

On the high energy side of the circuitry, a diode 150 is provided as a clamping diode which also provides a path or current flow after the plug has been fired. This device keeps the capacitor bank from seeing a high negative voltage as the igniter current passes through 0. In prior art designs this clamping diode saw high current levels for a large percentage of the energy discharge because the underdamped discharge characteristics were dominated by a wave shaping inductor. The proposed low voltage, high capacitance system does not conduct appreciable current through this clamping diode, because the higher capacitance values associated with a low voltage system (124) provide for more damping in the RLC discharge network.

Further advantages of the low voltage, high capacitance system relative to the prior art high voltage, low capacitance systems are as follows. The discharge characteristics in a high capacitance system are dominated by the capacitor. If the external conditions place more resistance between the exciter and the igniter, the peak current decreases while the current duration increases. The decreasing peak current tends to decrease the energy delivery to the igniter while the increasing current duration tends to increase the energy delivery to the igniter. They tend to cancel each other out and reduce the variation in total energy delivered to the igniter as a function of external resistance. In contrast, the prior art, low capacitance, unipolar systems discharge their capacitors relatively instantaneously and rely on a wave shaping inductor to provide energy to the igniter during the majority of the discharge. If the external conditions place more resistance between the exciter and the igniter, the peak current decreases while the current duration also decreases. Both of these reductions decrease the energy delivered to the igniter. Thus, the low capacitance, unipolar systems have a higher variation in total energy delivered to the igniter as a function of external resistance relative to a high capacitance system.

From the foregoing discussion, it should be appreciated that an ignition system has been shown and described which has many desirable attributes and advantages. The system advantageously utilizes a low energy ignition circuit and transformer to provide a very high voltage pulse that is applied to the igniter plug 120 and produces ionization and breakdown before the energy from a high energy capacitor bank is applied to sustain the spark initially produced by the high voltage pulse. The unique design of the system does not subject the step-up transformer that generates the high voltage pulse to the very high current flow that originates with the high energy capacitor. Importantly, the use of a low voltage bus in the high energy ignition circuit portion of the system results in advantageous use of less expensive semiconductor devices and yet produces a highly reliable and effective ignition system.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. An ignition system comprising:

an igniter for creating a spark;

a step-up transformer having a primary winding and a secondary winding the secondary winding being operably connected to one terminal of said igniter, a first energy storage device for providing a first amount of energy at a first voltage level, one terminal of said device being connected to a second terminal of said igniter;

a first switch connected to said first energy storage device for controlling the release of energy therefrom, said first switch being connected to said one terminal of said igniter through said secondary winding of said transformer;

a second energy storage device for releasing a second amount of energy at a second voltage level to said primary winding of said transformer;

a second switch connected in circuit with said primary winding for controlling the release of energy from said second energy storage device through said primary winding of said transformer, said energy being transformed to a stepped-up third voltage level and applied to said igniter when said second switch is triggered into conduction;

an electrical bypass connected to said first switch and said one terminal of said igniter in parallel with said secondary winding of said transformer, thereby permitting said first amount of energy to bypass said secondary winding of said transformer and be applied to said one terminal of said igniter; and, a charging circuit for charging said first and second energy storage devices; and, a controller for triggering said first and second switches.

2. An ignition system as defined in claim 1 wherein said controller triggers said first switch and triggers said second switch a predetermined time after it triggers said first switch.

3. An ignition system as defined in claim 2 wherein said predetermined time is within the range of approximately 0.1 microseconds to 100 microseconds.

4. An ignition system as defined in claim 1 wherein said second switch is a silicon controlled rectifier (SCR).

5. An ignition system as defined in claim 1 wherein said first switch comprises a pair of silicon controlled rectifiers (SCR's) connected in parallel to one another.

6. An ignition system as defined in claim 5 further comprising a saturable reactor connected in series to each SCR of said SCR pair, said reactor limiting the current flow through the SCR for a predetermined time duration to protect each SCR from damage while it is triggered into conduction.

7. An ignition system as defined in claim 6 wherein said predetermined time duration is approximately 1–10 microseconds.

8. An ignition system as defined in claim 1 wherein said second energy storage device is a capacitor, said second amount of energy is less than 2 Joules and said second voltage level is less than 1000 VDC.

9. An ignition system as defined in claim 1 wherein said first energy storage device is one or more capacitors, said first amount of energy is less than 20 Joules and said first voltage level is less than 2000 VDC.

10. An ignition system as defined in claim 1 wherein said third stepped-up voltage level is to a level required for ionization.

11. An ignition system as defined in claim 1 wherein said bypass comprises one or more diodes.

12. An ignition system as defined in claim 1 further comprising a negative clamping diode connected in parallel with said first energy storage device with its anode connected to said second terminal of said igniter.

13. An ignition circuit for use with an igniter for creating a spark, comprising:

transformer means having a primary winding and a secondary winding and being configured to step-up a first voltage level applied to said primary winding to a higher second voltage level, the secondary winding being electrically connected to one terminal of the igniter;

first storage means for providing a first amount of energy at a third voltage level, one terminal of said storage means being connected to a second terminal of the igniter;

a first switch for controlling the release of energy from said first storage means;

second storage means for releasing a second amount of energy at said first voltage level to said primary winding of said transformer;

a second switch for controlling the release of energy from said second storage means, said energy being transformed to said second voltage level and applied to the igniter when said second switch is triggered into conduction;

bypass means connected to said first switch and said one terminal of the igniter in parallel with said secondary winding of said transformer means, thereby permitting said first amount of energy to bypass said secondary winding of said transformer means and be applied to said one terminal of the igniter;

a low voltage bus for powering components for operating said circuit; including charging said first and second energy storage devices; and, a controller for triggering said first switch followed by triggering said second switch.

14. An ignition circuit as defined in claim 13 wherein said low voltage bus has a voltage level less than approximately 2000 VDC.

15. An ignition circuit as defined in claim 13 wherein said second storage means is a capacitor, said second amount of energy is less than 2 Joules and said first voltage level is less than 1000 VDC.

16. An ignition circuit as defined in claim 13 wherein said first energy storage device comprises one or more capacitors, said first amount of energy is less than 20 Joules and said third voltage level is less than 2000 VDC.

17. An ignition circuit as defined in claim 13 wherein said second stepped-up voltage level is the level required for igniter ionization.

18. A method of igniting fuel in an engine comprising the steps of:

charging a first energy storage device to a first predetermined energy level utilizing a first predetermined voltage;

charging a second energy storage device to a second predetermined energy level utilizing a second predetermined voltage;

triggering a first switch at a first time, the first switch being connected in series with the first energy storage device and one or more bypass diodes, the diodes being connected in parallel with a secondary winding of a step-up transformer; and, triggering a second switch connected in series with said second energy storage device and a primary winding of said transformer into conduction at a second time later than said first time and applying the energy from said second energy storage device to the primary of the step-up transformer, the energy applied to the primary winding producing a stepped-up voltage in the secondary winding of said transformer;

applying the stepped-up voltage to a sparking generating device to create a spark for the purpose of igniting fuel in the engine; and, applying the energy from said first energy storage device to said spark generating device.

19. A method as defined in claim 18 wherein said second time is within the range of approximately 0.1 microseconds to 100 microseconds later than said first time.

20. A method as defined in claim 18 wherein said second energy storage device is a capacitor, said second predetermined energy level is less than 2 Joules and said second predetermined voltage is less than 1000 VDC.

21. A method as defined in claim 18 wherein said first energy storage device is one or more capacitors, said first predetermined energy level is less than 20 Joules and said first predetermined voltage is less than 2000 VDC.

22. A method as defined in claim 18 wherein said stepped-up voltage is a voltage level required for ionization and is up to approximately 40,000 VDC.

23. A method of generating a spark utilizing a circuit that has a step-up transformer with a primary winding and a secondary winding, the circuit having a primary side and a secondary side, the primary side including a low energy storage device and a primary side switch, the secondary side having a spark generating device and including a high energy storage device connected to the spark generating device through a secondary side switch and a bypass means connected in parallel to the secondary winding of the transformer, and a charging means for charging the high and low energy storage devices, comprising the steps of:

charging the high and low energy storage devices to their respective energy levels at a respective relatively low voltages within a predetermined range;

triggering the secondary side switch at a first time;

triggering the primary side switch into conduction at a second time later than the first time and applying the energy from said low energy storage device to the primary winding, the energy applied to the primary winding producing a stepped-up voltage in the secondary winding of the transformer;

applying the stepped-up voltage to the spark generating device to create a spark;

applying the energy from said high energy storage device to the spark generating device through the secondary side switch and the bypass means.

24. A method as defined in claim 23 wherein said second time is within the range of approximately 0.1 microseconds to 100 microseconds later than said first time.

25. A method as defined in claim 23 wherein said low energy storage device is charged at a charging voltage of less than 1000 VDC to an energy level of less than 2 Joules.

26. A method as defined in claim 23 wherein said high energy storage device is charged at a charging voltage of less than 2000 VDC to an energy level of less than 20 Joules.

27. A method as defined in claim 23 wherein said stepped-up voltage is a voltage level sufficient for ionization.

28. A method of utilizing an igniter circuit that has a step-up transformer with a primary winding and a secondary winding, the circuit having a primary side and a secondary side, the primary side including means for applying energy to the primary winding, the secondary side being operably connected to an igniter in the engine and including a high energy storage device connected to the igniter through a secondary side switch and a bypass means connected in parallel to the secondary winding of the transformer, and a charging means for charging the high energy storage device, comprising the steps of:

charging the high energy storage device to its energy level at a relatively low voltage;

triggering the secondary side switch at a first time;

applying energy to the primary winding after triggering the secondary side switch, the energy applied to the primary winding producing a stepped-up voltage in the secondary winding of the transformer;

applying the stepped-up voltage to the igniter to create a spark for the purpose of igniting fuel in the engine;

applying the energy from said high energy storage device to the igniter through the secondary side switch and the bypass means.

29. An exciter circuit for use with an igniter for creating a spark for igniting fuel in an engine; comprising:

transformer means having a primary winding and a secondary winding and being configured to step-up a first voltage level applied to said primary winding to a higher second voltage level, the secondary winding being electrically connected to one terminal of the igniter;

a high energy storage means for providing a first amount of energy at a low voltage level, one terminal of said storage means being connected to a second terminal of the igniter;

a switch for controlling the release of energy from said high energy storage means;

means for selectively providing energy to said primary winding of said transformer, said energy being transformed to said second voltage level and applied to the igniter;

bypass means connected to said switch and said one terminal of the igniter in parallel with said secondary winding of said transformer means, thereby permitting said first amount of energy to bypass said secondary winding of said transformer means and be applied to said one terminal of the igniter;

a controller for triggering said switch followed by operating said energy providing means.

30. An exciter circuit as defined in claim 29 wherein said low voltage energy level is below approximately 2000 VDC.

31. An energy discharge system having an output, said system comprising:

a step-up transformer having a primary winding and a secondary winding, said secondary winding being connected to the output, an energy storage device for providing high current energy to the output;

a switch for controlling the release of energy from said energy storage device;

an electrical bypass connected in circuit to said switch and the output and in parallel with said secondary winding of said transformer, thereby permitting said high current energy to bypass said secondary winding of said transformer and be applied to the output.

32. An energy discharge system as defined in claim 31 further comprising a second energy storage device connected in circuit with said primary winding of said transformer for supplying a second amount of energy for application to said primary winding.

33. An energy discharge system as defined in claim 32 further comprising a second switch connected in series with said primary winding for applying said second amount of energy to said primary winding.

34. An energy discharge system as defined in claim 33 further including a controller for selectively operating said switch and said second switch.

* * * * *